US005381772A

United States Patent [19]

Melchior et al.

[11] Patent Number: 5,381,772

[45] Date of Patent: Jan. 17, 1995

[54] LIQUID FUEL INJECTION DEVICE FOR AN INTERNAL COMBUSTION ENGINE, AND ENGINE EQUIPPED WITH SUCH A DEVICE

[75] Inventors: Jean F. Melchior, 126 Boulevard du Montparnasse, 75 014 Paris; Thierry Andre, Paris, both of France

[73] Assignee: Jean-Frederic Melchior, Paris, France

[21] Appl. No.: 112,372

[22] Filed: Aug. 27, 1993

[30] Foreign Application Priority Data

Aug. 27, 1992 [FR] France ..... 92 10322

[51] Int. Cl.[6] ..... F02M 7/00

[52] U.S. Cl. ..... 123/447

[58] Field of Search ..... 123/447, 467

[56] References Cited

U.S. PATENT DOCUMENTS 3,625,192 12/1971 Dreisin .
4,089,315 5/1978 Lakra .
4,333,436 6/1982 Kopse et al. ..... 123/467
4,633,836 1/1987 Faupel ..... 123/447
4,976,244 12/1990 Eckert ..... 123/447
4,982,713 1/1991 Buisson ..... 123/467
5,195,487 3/1993 Zürner et al. ..... 123/447
5,199,402 4/1993 Melchior ..... 123/447

FOREIGN PATENT DOCUMENTS 0441738 8/1991 European Pat. Off. .
2086473 5/1982 United Kingdom .

*Primary Examiner*—E. Rollins Cross
*Assistant Examiner*—Thomas N. Moulis
*Attorney, Agent, or Firm*—Larson and Taylor

[57] ABSTRACT

Fuel injection device for an internal combustion engine, and engine equipped with such a device. The device includes a first cavity (3) forming part of a fuel pressurizing member (3, 4, 5), and a second cavity (12) made in an injector (9), in which cavity the pressure tends to lift a movable needle (11), against the action of the pressure in an accumulator (20), transmitted by a pipe (35). The first cavity (3) is separated from the second cavity (22) by a one-way valve (30).

15 Claims, 6 Drawing Sheets

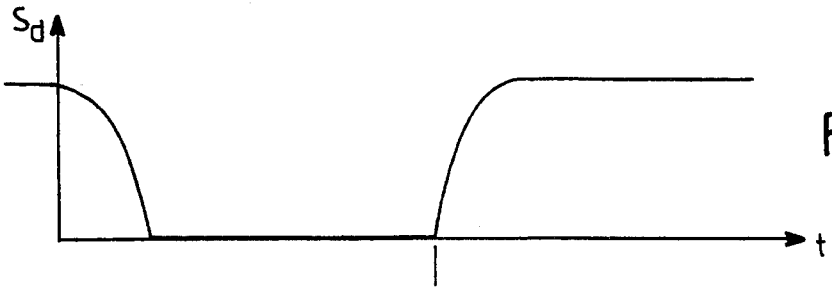
FIG.6
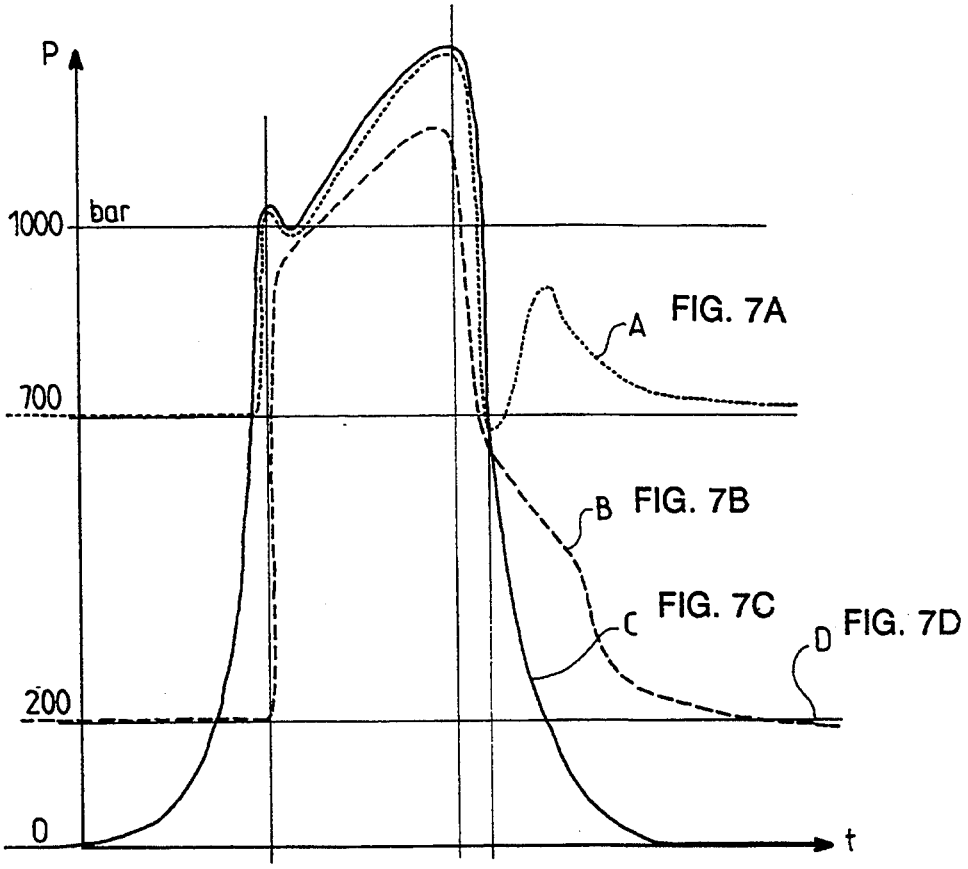
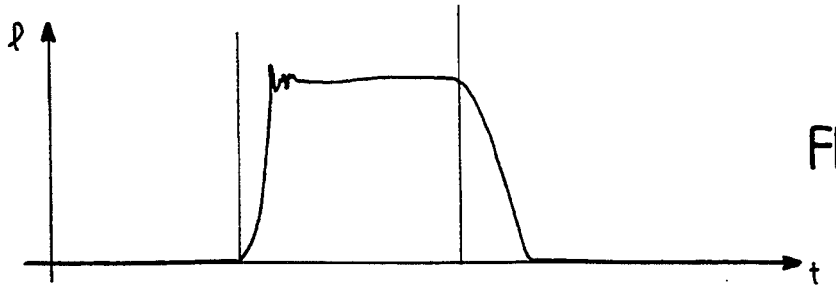
FIG.8

LIQUID FUEL INJECTION DEVICE FOR AN INTERNAL COMBUSTION ENGINE, AND ENGINE EQUIPPED WITH SUCH A DEVICE

The invention relates to a device for injecting

The invention relates to a device for injecting liquid fuel into at least one pressurized combustion chamber forming part of an internal combustion engine, which device includes a member for pressurizing the liquid fuel to be injected, consisting of a first variable-volume cavity, delimited by a piston given a reciprocating movement inside a cylinder, which first cavity communicates on the one hand with low-pressure liquid fuel reserve means by means of a control member which cyclically establishes such a communication in synchronism with the periodic operation of said engine and, on the other hand, by means of a passage with an injector made up of a nozzle and of a movable needle, which is axially symmetric, which nozzle includes a second cavity connected to the abovementioned passage and delimited laterally by a cylindrical wall of circular directrix (cross section) and axially by a partially conical wall forming a seat and which is coaxial with said cylindrical wall, and at least one injection orifice opening out into the combustion chamber, a low volume space or "sac" being arranged between the abovementioned seat and the injection orifice or orifices, which needle includes a cylindrical part forming a piston and capable of sliding with a minimum functional clearance inside the abovementioned cylindrical wall of the nozzle and a conical part cooperating with the abovementioned seat, which needle is set out on the one hand so as to be held, at rest, bearing on its seat by return means so as to interrupt the communication between the second cavity and the injection orifice or orifices and, on the other hand, so that its cross-section for bearing on the seat, projecting onto a plane perpendicular to the axis of the needle, is less than the transverse section of the cylindrical part of the needle which cylindrical part forms a piston, the free face of this cylindrical part of the needle delimiting a third variable-volume cavity which communicates with a pressurized accumulator for said fuel, thus constituting the abovementioned return means, the abovementioned accumulator communicating with means for pressurizing to a substantially constant pressure, for each operating range of the engine.

Such an injection device is described in the French Patent Application No. 91 02208 of Feb. 25, 1991 (or U.S. Pat. No. 5,199,402), which was not published before the date of filing of the present application.

The object of the invention is to set out the injection device defined hereinabove so that the decompression of the first cavity is not propagated into the second cavity, giving rise to "injection tail offs" at low pressure, which generates smoke in the exhaust and soot. The object is also to set out this injection device so that the needle falls back onto its seat as gently as possible at the end of each injection period whilst maintaining the liquid fuel pressure level which is necessary for the atomization and penetration of the droplets of fuel into the combustion chamber, in particular towards the end of each injection period.

To this end, the injection device in accordance with the invention is essentially characterized in that the first cavity is separated from the second cavity by a one-way valve, preferably with a very low swept volume and very low inertia, oriented so as to allow the liquid fuel to flow from the first cavity to the second cavity and to prevent the flow in the opposite direction, and set out in such a way that its closure, brought about by the decompression of the first cavity, does not give rise to a substantial drop in the pressure prevailing in the second cavity.

In accordance with an advantageous embodiment, the abovementioned means for pressurizing the accumulator to a substantially constant pressure consist of a pressurized fuel supply and of a communication with the abovementioned low-pressure liquid fuel reserve means by means of a leakage orifice, of variable passage cross-section, equipped with adjustment means set out so as to keep the liquid fuel in the accumulator at the abovementioned substantially constant pressure. According to a first solution, the abovementioned pressurized fuel supply consists of a communication which is established between the first cavity and the third cavity, and on which are interposed a one-way valve and a calibrated orifice mounted in series. According to a second solution, the abovementioned pressurized fuel supply consists of a communication between the second cavity and the third cavity, and on which is interposed a calibrated orifice.

Thus, an injection device is obtained which clearly attains the objective defined hereinabove, as will be explained hereafter with the aid of the appended drawings.

FIG. 1 of these drawings represents diagrammatically the preferred embodiment of the prior art and such as described in the abovementioned French Patent Application No. 91 02208 of Feb. 25, 1991.

Figure 2:
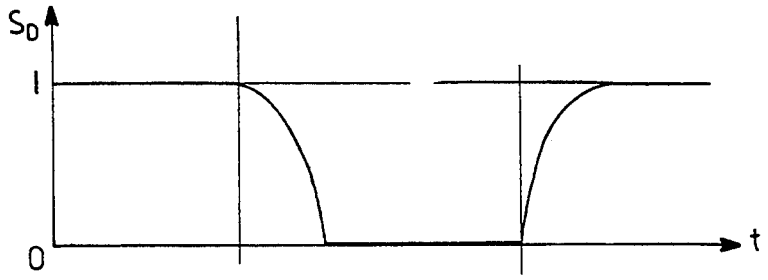
FIG. 2 PRIOR ART
FIGS. 2, 3 and 4 are diagrams illustrating the operation and drawbacks of an injection device of known type.
Figure 3:
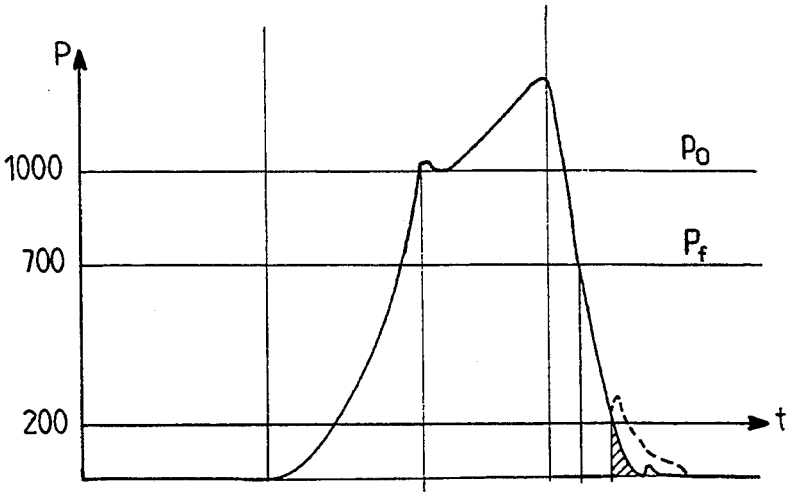
FIG. 3 PRIOR ART
Figure 4:
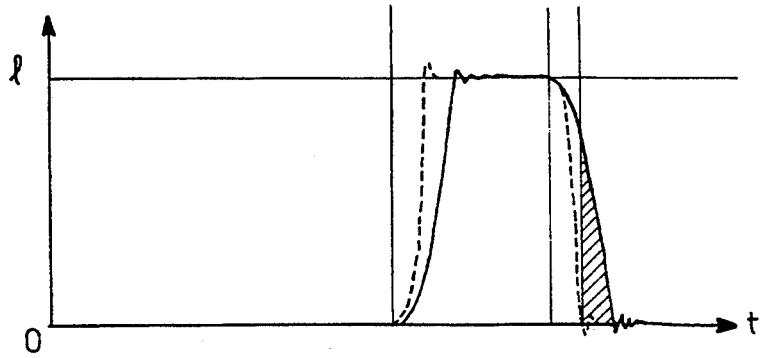
FIG. 4 PRIOR ART

FIGS. 6, 7A–D and 8 are diagrams illustrating the operation and advantages of the injection device in accordance with the invention, and corresponding respectively to those of FIGS. 2, 3 and 4.

Figure 9:
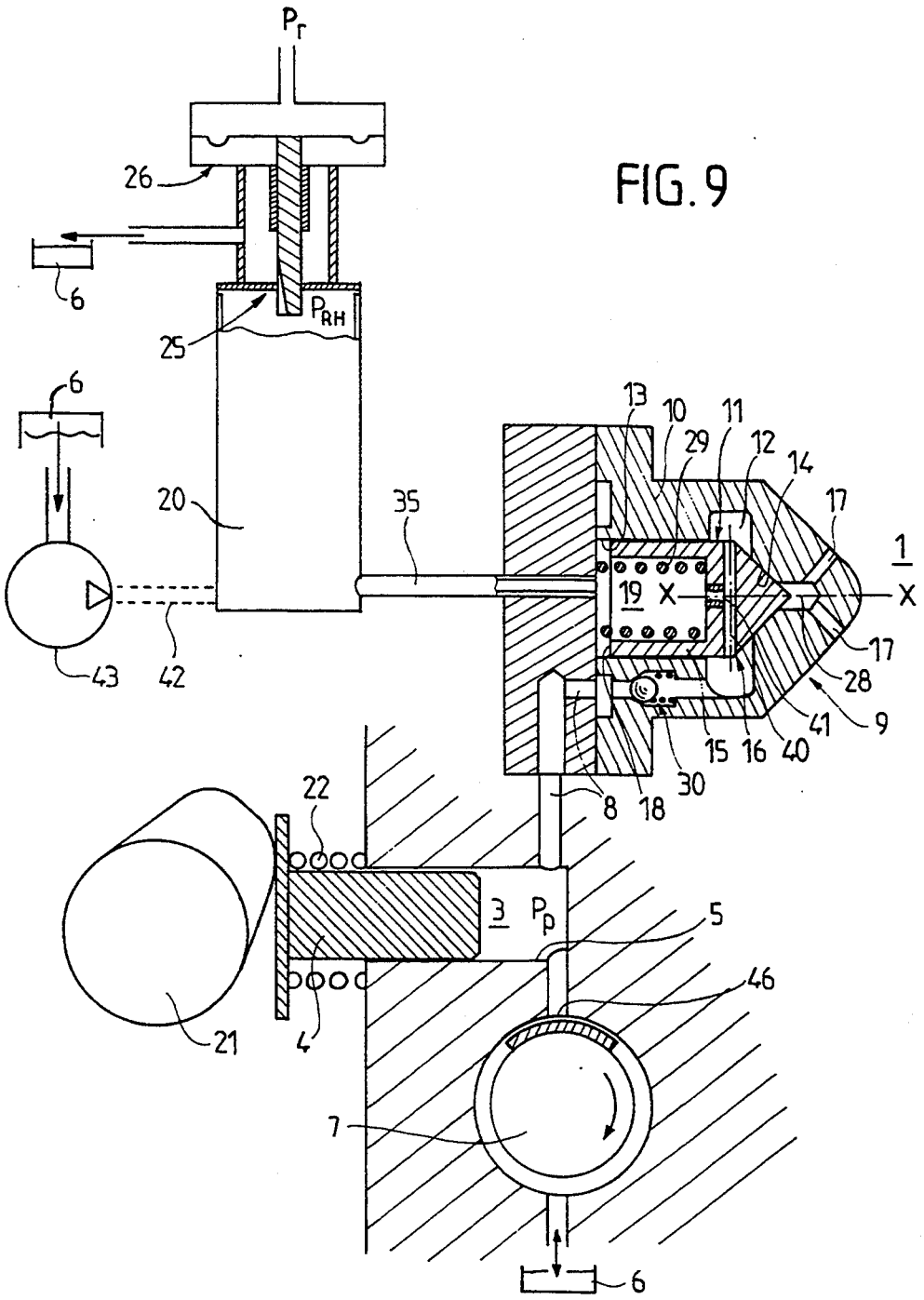
Figure 10:
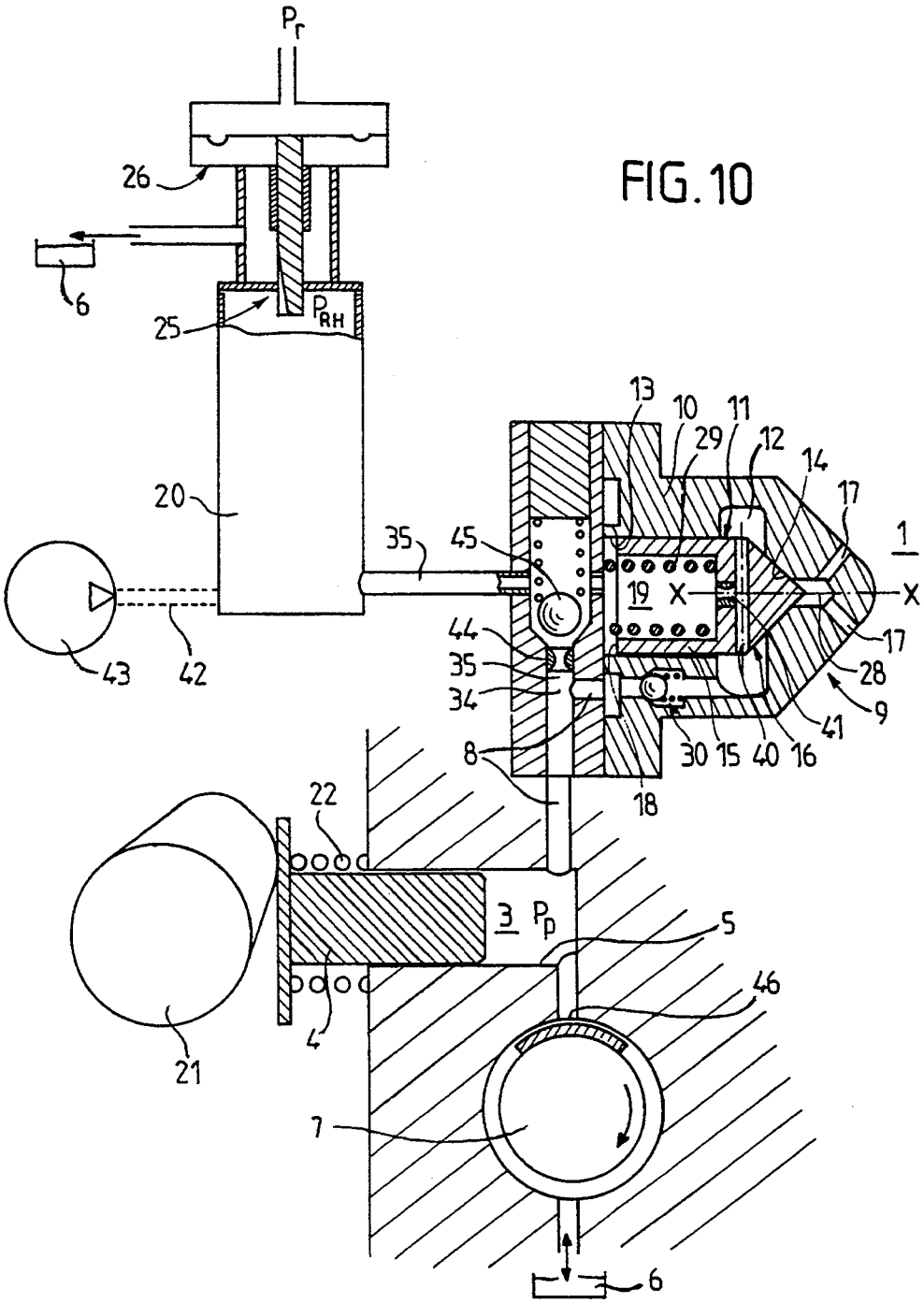

FIGS. 9 and 10 each diagrammatically represent a preferred embodiment of the invention.

Figure 11:
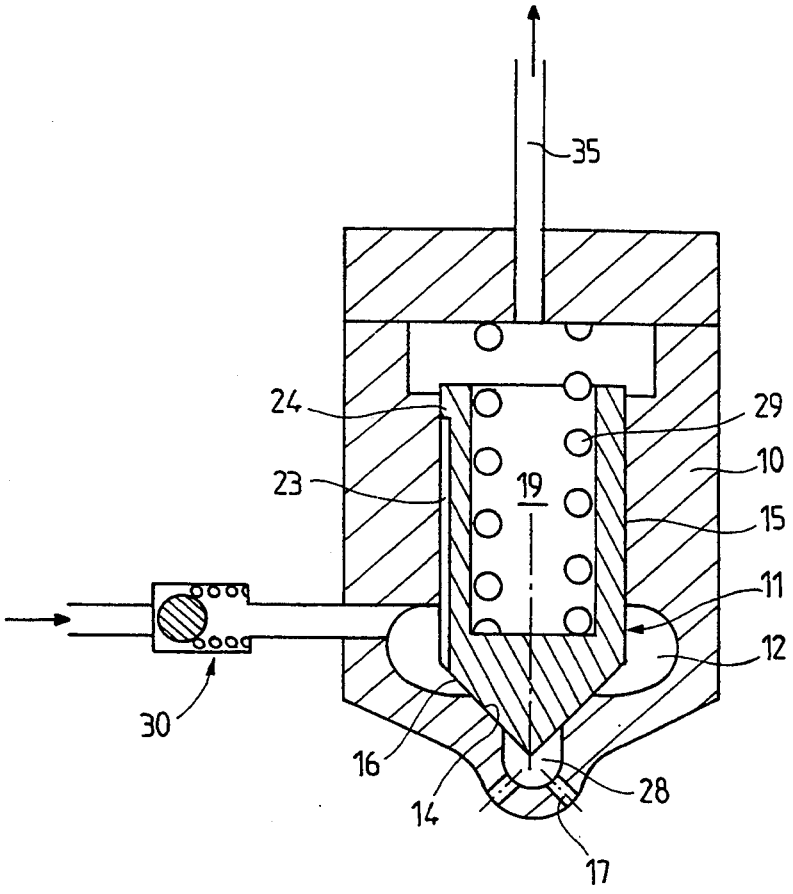

FIG. 11 illustrates, on a larger scale, a variant of the needle of FIGS. 9 and 10.

Figure 1:
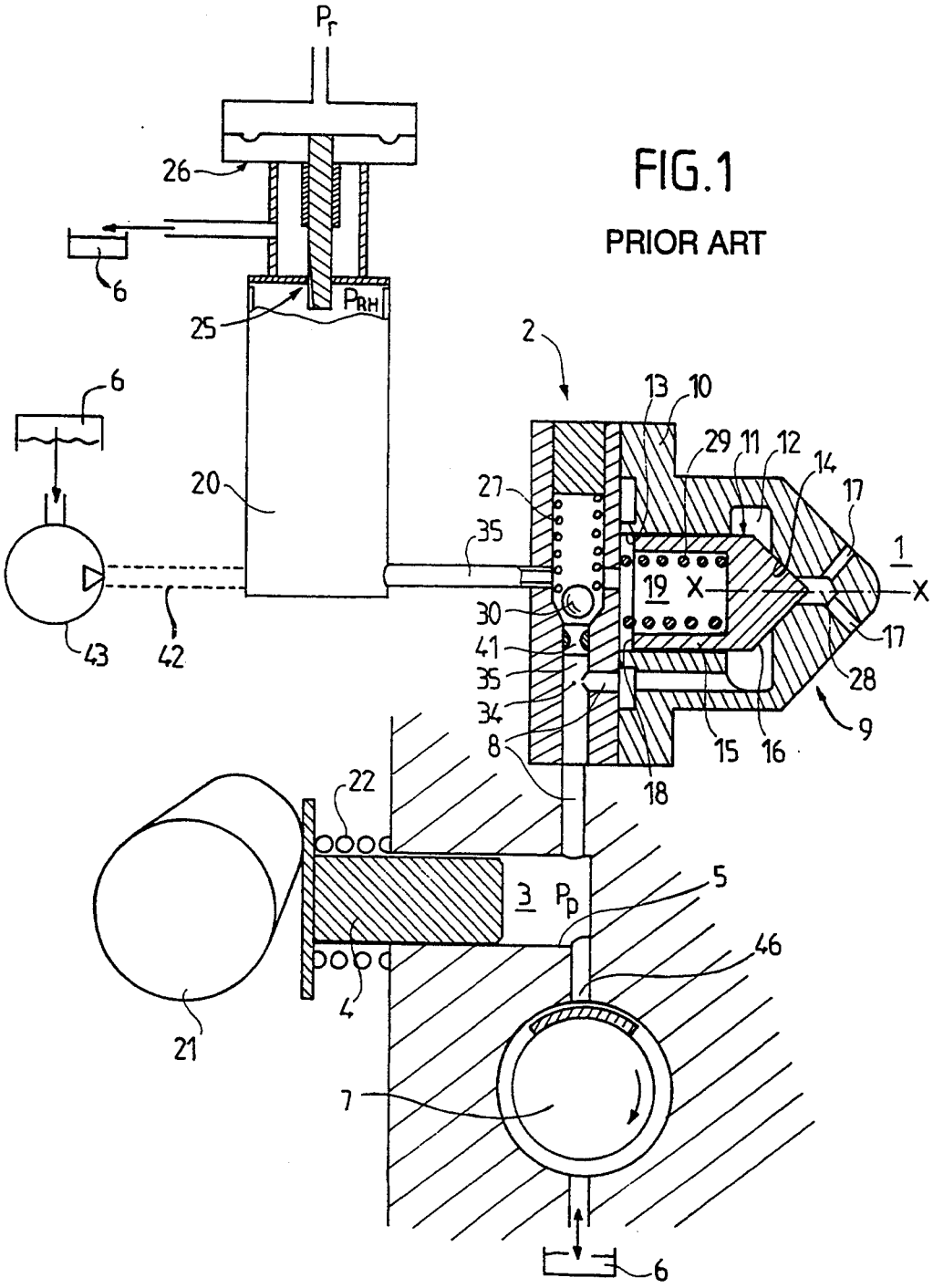
FIG.1 PRIOR ART

As illustrated in FIG. 1, the injection device is intended to inject liquid fuel into a pressurized combustion chamber 1 of an internal combustion engine 2, the number of chambers 1 of which may be determined as desired.

Before describing the invention, FIG. 1 will be used to recall the state of the art such as it emerges from the abovementioned French Patent Application No. 91 02208. In this case, the injection device includes a member for pressurizing the liquid fuel to be injected, consisting of a first variable-volume cavity 3, delimited by a piston 4 given a reciprocating movement inside a cylinder 5. The first cavity 3 communicates on the one hand with low-pressure liquid fuel reserve means (or tank) 6 by means of a control member (such as a rotary distributor) 7 which establishes such a communication in synchronism with the operation of the engine 2 and, on the other hand, by means of a passage 8 with an injector 9 made up of a nozzle 10 and of a movable needle 11, having an axially symmetric shape. This nozzle 10 includes a second cavity 12 connected to the passage 8 and delimited laterally by a cylindrical wall 13 of circular directrix and axially by a partially conical wall 14 forming a seat and which is coaxial with said cylindrical wall 13. The nozzle 10 also comprises at least one injection orifice 17 opening out into the combustion chamber 1. A low volume space or "sac" 28 is arranged between the seat 14 and the injection orifice or orifices 17.

The needle 11 includes a cylindrical part 15 forming a piston and capable of sliding with a minimum functional clearance inside the cylindrical wall 13 of the nozzle 10 and a conical part 16 interacting with the seat 14.

The needle 11 is set out so as to be held, at rest, bearing on the seat 14 by return means which will be described hereafter so as to interrupt the communication between the second cavity 12 and the injection orifice or orifices 17. The needle 11 is furthermore set out like a differential piston so that its cross-section for bearing on the seat 14, projecting onto a plane perpendicular to the axis X—X of the needle 11, is less than the transverse section of the cylindrical pare 15 of the needle 11 which cylindrical part forms a piston. The free face 18 of this cylindrical part 15, that is to say its face which is distant from the conical part 16, delimits a third variable-volume cavity 19 which communicates with a pressurized accumulator 20 for said liquid fuel, thus constituting the abovementioned return means.

The pump piston 4 may receive its reciprocating movement either, as shown diagrammatically in FIG. 1, from a rotary cam 21 driven in synchronism with the engine 2, against the action of a return spring 22, or from hydraulic means, an example of which is described in document FR-A-2,326,588 ( or U.S. Pat. No. 4,089,315) or from any other equivalent means. The cam 21 may act on the piston 4 either directly (as represented diagrammatically in FIG. 1), or more generally by means of a rocker (not shown).

The first cavity 3 communicates with the third cavity 19 by means of the calibrated orifice 41 and of a one-way valve (or non-return valve) 30 which are mounted in series, and the abovementioned accumulator 20 communicates with the abovementioned low-pressure liquid fuel reserve means 6 by means of a leakage orifice 25, of variable passage cross-section, equipped with adjustment means 26 set out so as to keep the pressure of the liquid fuel in the accumulator 20 at a substantially constant value, for each operating range of the engine 2. As shown in FIG. 9, the one-way valve 30 may consist of a ball subjected to the action of a return spring 27 and it is in any case set out to allow the liquid fuel forced out by the piston 4 to reach the third cavity 19 and the accumulator 20 and to prevent a return in the opposite direction.

External pressurizing means 43 fed by the low-pressure tank 6 may communicate with the abovementioned accumulator 20 by virtue of the pipe 42.

The means for returning the needle 11 to its seat 14 preferably further include a mechanical spring 29 dimensioned to allow the operation of the device when the engine 2 is started up, while the pressure of the liquid fuel has not yet been established in the accumulator 20.

The adjustment means 26 are preferably sensitive to at least one operating parameter Pr of the engine 2 and set out so as to slave the substantially constant pressure prevailing in the accumulator 20 to this operating parameter.

Moreover, the second cavity 12 communicates directly with the first cavity 3, the calibrated orifice 41 and the one-way valve 30 not being interposed on the pipe 8 connecting the first cavity 3 to the second cavity 12, but on a pipe 35 which is branched off the passage 8 at 34 and ends in the accumulator 20 which it further connects to the third cavity 19.

The injection device which has just been described until now is in accordance with the abovementioned French Patent Application No. 91 02208. The operation thereof will be recalled hereafter.

When the needle 11 is bearing on its seat 14 it is subjected, in the closure direction, to the pressure prevailing in the third cavity 19 and acting on the entire cross-section of its cylindrical part 15 and, in the opening direction, to the pressure prevailing in the second cavity 12, on the difference between the cross-section of the cylindrical part 15 and its cross-section for bearing on the seat 14. During each forcing stroke of the piston 4, the discharge orifice 46 of the pump is closed by the rotary distributor 7 and the pressure transmitted by the passage 8 into the second cavity 12 increases until its action on the needle 11 becomes preponderant and the needle 11 moves away from its seat 14, which allows some of the pressurized liquid fuel admitted to the second cavity 12 to reach the orifice or orifices 17 via the sac 28 and to be injected into the combustion chamber 1. The differential effect of the needle 11 brings it into full abutment. When the control member 7 reestablishes the communication between the first cavity 3 and the low-pressure liquid fuel reserve means 6, the pressure prevailing in the second cavity 12 drops and allows the pressure prevailing in the third cavity 19 to return the needle 11 onto its seat 14. More precisely, when the injection pressure falls below the closing pressure of the needle 11 (this closing pressure being less than the opening pressure, owing to the differential effect), the needle 11 starts to fall. Injection stops when the needle 11 falls back onto seat 14, the differential effect to a certain extent preventing bouncing of the needle.

The one-way valve 30 maintains the pressure in the accumulator 20 during the intake stroke of the piston 4 (or when the first cavity 3 is made to discharge using the control member 7) and therefore prevents the accumulator 20 from emptying by means of the passage 8 and from thus interfering with the operation described above of the needle 11. By the simple action of the adjustment means 26, the constant value $P_{RH}$ at which the pressure is maintained in the accumulator 20 may be adapted to the operating conditions of the engine 2. In particular, it makes it possible to adjust automatically, during the operation of the engine 2, the value of the pressure of the liquid fuel in the second cavity 12, upstream of the injection orifice or orifices 17, as a function of the value of the gaseous pressure prevailing in the combustion chamber 1 downstream of said orifice or orifices 17, so as to maintain optimum atomizing and penetration conditions of the liquid fuel injected into the combustion chamber 1, at least for most of the stroke of the needle 11.

The regulations on the emissions of pollutants in the exhaust of diesel engines becomes increasingly Strict, in particular as regards emissions of smoke, particles and unburnt hydrocarbons.

In a diesel engine, combustion takes place in a non homogeneous fashion. Indeed, the droplets of finely atomized liquid fuel are mixed in the combustion chamber with air which is heated therein by adiabatic compression, either directly (plurality of jets of fuel in a calm medium: non-swirl chamber), or indirectly (limited number of jets in a medium given intense movement: swirl chamber).

The vaporized fuel ignites spontaneously as soon as the required pressure and temperature conditions are reached. The reaction develops very rapidly giving rise to intense local heating and causing the atomized fuel break down as far as cracking giving rise to the formation of soot. Most of the soot thus produced during the first part of the combustion period is burnt progressively and it therefore does not impair the composition of the exhaust gases (or impairs it very little). In contrast, the particles of soot produced at the end of the combustion period are much more troublesome because the time available for reburning them is obviously shorter. In addition, owing to the downward stroke of the piston, the thermodynamic conditions (pressure and temperature) in the combustion chamber are then less favourable to the continuance of the reaction. From this point of view, it is clear that the end of the injection period is much more critical than the beginning of this same period.

Moreover, owing to the differential effect created as was recalled hereinabove by the needle 11 bearing on its seat 14, the needle 11 opens at a high pressure and therefore poses no particular problem as regards the quality of atomization. Once the needle has moved away from its seat 14, the injection pressure is established over the entire lower surface of the needle 11 (that is to say its surface located to the right of FIG. 1), upstream of the injection orifice or orifices 17. The injection process ends in the needle falling back onto its seat 14, brought about by the cylinder 5 (or first cavity 3) of the injection pump being brought into communication with the low-pressure reserve means 6 by means of the discharge orifice At this stage, there arises a dilemma which is well known Go injection specialists:

if the drop in pressure is faster than the fall of the needle 11, the last instants of the injection take place under very poor conditions. Indeed, the slight pressure difference between upstream and downstream of the injection orifice or orifices 17 will give rise to the formation of large drops in the chamber 1, without injection speed. The incomplete combustion of this "injection tail off" will bring about the formation of smoke, particles and unburnt hydrocarbons.

One is tempted to shorten the duration of the needle 11 falling back onto its seat 14 in order to minimize this tardy production of pollutants, but one will then be confronted with the problem of the durability of the injector, of the integrity of the contact between the needle 11 and the seat 14, and of the weakening of the tip of the injector (weakened by the presence of the injection orifices 17). In the abovementioned French Patent Application No. 91 02208, a damping device has been provided in order to attenuate the impact of the needle 11 on its seat 14 but, despite its advantages, this solution has the effect of extending the time taken for the needle 11 to fall, and the previous drawback is then encountered again.

The diagrams of FIGS. 2 to 4 illustrate the phenomena which have just been described. On the same timescale t in abscissa:

FIG. 2 shows the evolution of the leakage cross-section So of the discharge orifice 46;

FIG. 3 shows the evolution of the injection pressure P (in bar), Po and Pf corresponding respectively to the opening pressure and closing pressure of the needle 11;

FIG. 4 shows the lift "l" of the needle 11.

In FIGS. 3 and 4, the curves in solid line correspond to a slow needle 11 (damped or with high inertia), most of the fall of the needle taking place with a very low injection pressure (generally less than 200 bar), hence smoke and unburnt hydrocarbons, and flowback of gases, from the chamber 1 to the injector. In the same figures, the curves in broken line correspond to a fast needle (lightweight, with low inertia, or not damped), the closure of the needle taking place with a high injection pressure (generally greater than 200 bar), hence impacts on the seat 14, and weakening.

Figure 5:
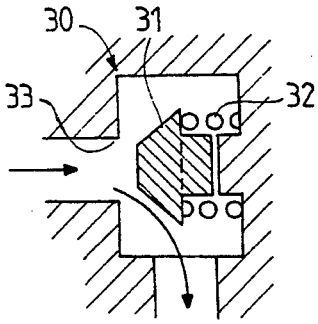
FIG. 5 shows a detail of one of the one-way valves of FIGS. 1 and 9.

That being the case, in accordance with the invention such as represented diagrammatically in FIG. 9, the first cavity 3 (that is to say the cavity delimited by the piston 4 of the pressurizing member) is separated from the second cavity 12 (that is to say the cavity located in the nozzle 10 upstream of the seat 14 of the needle 11) by the abovementioned one-way valve or non-return valve 30, preferably with a very low swept volume and very low inertia, oriented so as to allow the flow of liquid fuel from the first cavity 3 to the second cavity 12, and to prevent the flow in the opposite direction. Although the one-way valve 30 is represented in FIG. 9 as being of the same type as in FIG. 1, it is more advantageously made up, as shown in FIG. 5, a movable shut-off member 31 with a frusto-conical head urged by a spring 32. In any case, the "swept volume" the one-way valve 30 is defined as the volume displaced by the valve between its wide open position and its closed position, that is to say the product of the stroke of the valve times into the transverse section of its seat 33.

It can therefore be seen that in FIG. 9, the pipe 35 is not branched off from the passage 8, in contrast to FIG. 1, but leaves the third cavity 19, which clearly defines the change in place of the one-way valve 30. Moreover, the calibrated orifice 41 making the first cavity 3 communicate with the third cavity 19 is located downstream of the one-way valve 30 and is interposed on a passage 40 making the second cavity 12 communicate with the third cavity 19. According to the embodiment of FIG. 9, the passage 40 and the calibrated orifice 41 pass through the cylindrical part 15 of the needle 11.

When the needle 11 opens, the operation is the same as the one which was described hereinabove, valve 30 opening, practically offering no resistance the flow of the liquid fuel. When closed, the position, chosen in accordance with the invention, of the valve 30 modifies the operation in an original and unanticipated manner, as will be explained.

When the rotary distributor 7 clears the discharge orifice 46 of the pump by making the first cavity 3 communicate with the low-pressure liquid fuel circuit 6, the presence of the valve 30 prevents the pressure in the cavity 12 of the injector from dropping. The pressure in the sac 28 of the injector (under the needle 11) will decrease progressively in step with the injection which continues for as long as the pressure in the sac 28 is greater than the pressure prevailing in the combustion chamber 1. The pressure difference across the needle 11 will therefore increase progressively, which will accelerate the needle 11 towards the seat 14. When the needle 11 is close to the seat 14, the throttling of the liquid fuel between the seat 14 and the conical part 16 of the needle 11 causes the pressure in the sac 28 to drop. At the same time, the pressure prevailing in the cavity 12 will rise, owing to the inertia of the needle 11, and will increase until it takes up the differential effect (opening pressure greater than closing pressure).

As a consequence, the landing of the needle 11 on its seat 14 will take place gently whilst at the same time the injection pressure is maintained or even rises in the final landing phase. In fact, the fixed objective is clearly reached, as shown in FIGS. 6 to 8 which relate to the construction in accordance with the invention and which correspond respectively to FIGS. 2 to 4. In FIG. 7A–D, the curves A in dotted line, B in dashed line, and C in solid line show the variations, as a function of time, of the pressure in the injector (cavity 12), in the sac 28, and in the pump (or first cavity 3) respectively, the pressure in the chamber 1 being represented by the straight line D.

In the preferred embodiment, as represented diagrammatically in FIG. 9, the second cavity 12 communicates with the third cavity 19 through the passage 40 on which is interposed the calibrated orifice 41. This passage 40 may be set out in the body of the needle such as represented in FIG. 9. It may equally well be set out in the body of the nozzle 10.

The calibrated orifice may even be coincident with the needle clearance existing between the external diameter of the cylindrical part 15 of the needle 11 and the internal diameter of the cylindrical wall 13 of the nozzle 10 as will be explained hereafter with reference to FIG. 11. In this case, the calibrated orifice 41 is coincident with the passage 40. The tolerance of the needle 11 may for this reason be less strict, which will prevent matching the needle 11 with its nozzle 10 and will reduce the cost of the injection equipment.

In a solution such as represented in FIG. 10, a second communication is established in parallel between the first cavity 3 and the second cavity 19, a second calibrated orifice 44 being arranged in series with a second one-way valve 45 on a pipe 35 which is branched off from the passage 8 at 34, as in the case of FIG. 1.

As has been expounded in the foregoing, the calibrated orifice 41, as represented in FIGS. 9 and 10, may be coincident with the clearance existing between the external diameter of the cylindrical part 15 of the needle 11 and the internal diameter of the cylindrical wall 13 of the nozzle 10. In this case in particular, and as represented in FIG. 11, the communication between the second cavity 12 and the third cavity 19 on the circuit of which the calibrated orifice 41 is interposed, also includes shut-off means capable of interrupting this communication when the needle 11 is bearing on its seat 14 and of reestablishing this communication when said needle 11 is moved away from its seat 14. To this end, the cylindrical part 15 of the needle ! 1 is advantageously provided with at least one longitudinal groove 23 which may go, on the one hand, as far as the conical part 16 of the needle 11 but stopped, on the other hand, by a shoulder 24. Thus, when the needle 11 is on its seat 14 (as represented in FIG. 11), the shoulder 24 isolates the cavities 12 and 19 from one another whereas, when the needle 11 starts to move away from its seat 14, the groove or grooves 23 make the cavities 12 and 19 communicate with one another.

When the engine operates at a very low speed (especially during starting), the presence of the communication between the second cavity 12 and the third cavity 19 may prevent the pressure in the second cavity 12 from rising above the value of the pressure allowing the needle 11 to open (and greater than the pressure in the third cavity 19, owing to the differential effect of the needle 11 bearing on its seat 14). It is therefore preferable, by virtue of the groove 23, to establish this communication between the second cavity 12 and the third cavity 19 only when the needle 11 is lifted from its seat 14.

Although the invention has been described in its application to a single cylinder engine, it goes without saying that it can be applied with as much benefit to an engine having at least two cylinders or combustion chambers 1. In this case, it goes without saying that, as indicated in the abovementioned French Patent Application No. 91 02208, the accumulator 20 may preferably be unique and communicate with the third cavities belonging to each injector. More precisely in this case, each working chamber 1 is equipped with a fuel injection device in accordance with the invention, but the accumulator 20 is common to all the injection devices.

We claim:

1. A device for injecting liquid fuel into at least one pressurized combustion chamber forming part of an internal combustion engine having a low pressure liquid fuel reserve comprising:

a pressurizing member for pressurizing the liquid fuel to be injected, said pressurizing member including a cylinder and a first piston movable reciprocally in said cylinder such that a first variable-volume cavity is provided;

a pressurized accumulator for a portion of the fuel, said accumulator including a pressurizing means for pressurizing the fuel in said accumulator to a substantially constant pressure selected for various operating ranges of the engine;

a control member which cyclically establishes a communication of said first cavity with the fuel reserve in synchronism with a periodic operation of the engine;

an injector for injecting fuel into the combustion chamber, said injector communicating with said pressurizing member via a passage and including a nozzle and a needle movable along an axis in said nozzle, said nozzle including (a) a second cavity connected with said passage, said second cavity being bounded laterally by a circularly cylindrical wall and axially by a partially conical wall coaxial with said cylindrical wall and forming a seat, (b) at least one injection orifice opening into the combustion chamber, and (c) a low volume space located between said seat and said at least one injection orifice, said needle including a cylindrical second piston provided for close sliding movement along said cylindrical wall, said second piston having a free face at one axial end and a conical part at the other axial end movable into cooperating abutment with said seat whereby a projection on a plane perpendicular to the axis of a portion of said conical part which abuts said conical wall is less than a transverse cross section of said cylindrical part, and said injector further including a return means for holding said needle at rest with said conical part bearing against said seat whereby communication between said second cavity and said at least one orifice is prevented, said return means including a third variable-volume cavity bordered by said free face of said second piston which said third cavity communicates with said pressurized accumulator; and a one-way valve which allows fuel to flow only from said first cavity to said second cavity such that closure of said one-way valve is brought about due to the communication of said first cavity with the fuel reserve by said control member does not result in a substantial drop in a pressure prevailing in said second cavity.

2. A device for injecting liquid fuel as claimed in claim 1 wherein said one-way valve has a low sept volume and low inertia.

3. A device for injecting liquid fuel as claimed in claim 1 wherein said pressurizing means includes a pressurized fuel supply for the portion of the fuel, a communication from the fuel reserve to said pressurized fuel supply, a leakage orifice member of variable cross section in said communication, and an adjustment means for adjusting the position of said leakage orifice member in said communication such that the portion of the fuel in said pressurized fuel supply is maintained at the constant pressure selected.

4. A device for injecting liquid fuel as claimed in claim 3 wherein said pressurizing means further includes a second communication from said first cavity to said third cavity in which said second communication there is provided a one-way valve and a calibrated orifice mounted in series in said second communication.

5. A device for injecting liquid fuel as claimed in claim 3 wherein said pressurizing means further includes a second communication from the second cavity to said third cavity in which said second communication there is provided a calibrated orifice.

6. A device for injecting liquid fuel as claimed in claim 5 wherein said calibrated orifice is a clearance between said cylindrical second piston and said cylindrical wall.

7. A device for injecting liquid fuel as claimed in claim 5 wherein said second communication also includes a shut-off means for shutting off the flow of fuel through said second communication when said conical wall engages said seat and for allowing flow when said conical wall is disengaged from said seat.

8. An internal combustion engine comprising:

a low pressure liquid fuel reserve in which liquid fuel is contained;

a pressurized accumulator for a portion of the fuel, said accumulator including a pressurizing means for pressurizing the fuel in said accumulator to a substantially constant pressure selected for various operating ranges of the engine;

a pressurized combustion chamber; and a liquid fuel injection device for injecting the liquid fuel into said combustion chamber, said injection device including:

(i) a pressurizing member for pressurizing the liquid fuel to be injected, said pressurizing member including a cylinder and a first piston movable reciprocally in said cylinder such that a first variable-volume cavity is provided;

(ii) a control member which cyclically establishes a communication of said first cavity with said fuel reserve in synchronism with a periodic operation of the engine;

(iii) an injector for injecting fuel into said combustion chamber, said injector communicating with said pressurizing member via a passage and including a nozzle and a needle movable along an axis in said nozzle, said nozzle including (a) a second cavity connected with said passage, said second cavity being bounded laterally by a circularly cylindrical wall and axially by a partially conical wall coaxial with said cylindrical wall and forming a seat, (b) at least one injection orifice opening into said combustion chamber, and (c) a low volume space located between said seat and said at least one injection orifice, said needle including a cylindrical second piston provided for close sliding movement along said cylindrical wall, said second piston having a free face at one axial end and a conical part at the other axial end movable into cooperating abutment with said seat whereby a projection on a plane perpendicular to the axis of a portion of said conical part which abuts said conical wall is less than a transverse cross section of said cylindrical part, and said injector further including a return means for holding said needle at rest with said conical part bearing against said seat whereby communication between said second cavity and said at least one orifice is prevented, said return means including a third variable-volume cavity bordered by said free face of said second piston which said third cavity communicates with said pressurized accumulator; and (iv) a one-way valve which allows fuel to flow only from said first cavity to said second cavity such that closure of said one-way valve is brought about due to the communication of said first cavity with said fuel reserve by said control member does not result in a substantial drop in a pressure prevailing in said second cavity.

9. An internal combustion engine as claimed in claim 8 and further including at least one additional combustion chamber and an additional said injection device for said additional combustion chamber.

10. An internal combustion engine as claimed in claim 9 wherein said one-way valve of said injection device has a low sept volume and low inertia.

11. An internal combustion engine as claimed in claim 9 wherein said pressurizing means of said injection device includes a pressurized fuel supply for the portion of the fuel, a communication from the fuel reserve to said pressurized fuel supply, a leakage orifice member of variable cross section in said communication, and an adjustment means for adjusting the position of said leakage orifice member in said communication such that the portion of the fuel in said pressurized fuel supply is maintained at the constant pressure selected.

12. An internal combustion engine as claimed in claim 11 wherein said pressurizing means of said injection device further includes a second communication from said first cavity to said third cavity in which said second communication there is provided a one-way valve and a calibrated orifice mounted in series in said second communication.

13. An internal combustion engine as claimed in claim 11 wherein said pressurizing means of said injection device further includes a second communication from the second cavity to said third cavity in which said second communication there is provided a calibrated orifice.

14. An internal combustion engine as claimed in claim 13 wherein said calibrated orifice is a clearance between said cylindrical second piston and said cylindrical wall.

15. An internal combustion engine as claimed in claim 13 wherein said second communication also includes a shut-off means for shutting off the flow of fuel through said second communication when said conical wall engages said seat and for allowing flow when said conical wall is disengaged from said seat.

* * * * *